US007583246B2

(12) United States Patent
Ito

(10) Patent No.: US 7,583,246 B2
(45) Date of Patent: Sep. 1, 2009

(54) DISPLAY DRIVER, ELECTRO-OPTICAL DEVICE AND DRIVE METHOD

(75) Inventor: Satoru Ito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 665 days.

(21) Appl. No.: 10/891,003

(22) Filed: Jul. 15, 2004

(65) Prior Publication Data

US 2005/0068278 A1 Mar. 31, 2005

(30) Foreign Application Priority Data

Jul. 24, 2003 (JP) ..... 2003-279172

(51) Int. Cl.
*G09G 3/36* (2006.01)

(52) U.S. Cl. ..... 345/100

(58) Field of Classification Search ..... 345/87–111
See application file for complete search history.

(56) References Cited

U.S. PATENT DOCUMENTS

| | | | | |
|---|---|---|---|---|
| 3,942,117 | A * | 3/1976 | Cunningham | 375/309 |
| 5,179,371 | A * | 1/1993 | Yamazaki | 345/93 |
| 5,502,417 | A * | 3/1996 | Uriya | 327/541 |
| 6,002,761 | A * | 12/1999 | Sremac | 379/373.04 |
| 6,115,020 | A * | 9/2000 | Taguchi et al. | 345/99 |
| 6,281,708 | B1 * | 8/2001 | Kenny | 326/86 |
| 6,316,997 | B1 * | 11/2001 | Tammone, Jr. | 330/254 |
| 7,002,568 | B2 * | 2/2006 | Morita | 345/211 |
| 7,154,350 | B2 * | 12/2006 | Seki | 331/158 |
| 2002/0190973 | A1 | 12/2002 | Morita | |
| 2003/0006979 | A1 * | 1/2003 | Tsuchi et al. | 345/204 |
| 2003/0034948 | A1 * | 2/2003 | Imamura | 345/98 |
| 2003/0067359 | A1 * | 4/2003 | Darabi et al. | 331/46 |
| 2005/0225518 | A1 * | 10/2005 | Yamada et al. | 345/77 |

FOREIGN PATENT DOCUMENTS

| | | |
|---|---|---|
| JP | A 7-306661 | 11/1995 |
| JP | A 9-6278 | 1/1997 |
| JP | A 9-146489 | 6/1997 |
| JP | A 2001-305510 | 10/2001 |
| JP | A 2002-351412 | 12/2002 |
| JP | A 2003-131630 | 5/2003 |

OTHER PUBLICATIONS

U.S. Appl. No. 10/954,054, filed Sep. 30, 2004, Ito.
U.S. Appl. No. 10/954,051, filed Sep. 30, 2004, Ito.

* cited by examiner

*Primary Examiner*—Srilakshmi K Kumar
(74) *Attorney, Agent, or Firm*—Oliff & Berridge, PLC

(57) ABSTRACT

A display driver which drives at least a plurality of scan lines of a display panel having a plurality of data lines and a plurality of pixels in addition to the scan lines. The display driver includes a plurality of scan drive cells and a plurality of coincidence detection circuits. Each of the scan drive cells drives one of the scan lines. Each of the coincidence detection circuits is connected to one of the scan drive cells, compares an address exclusively assigned to at least one of the scan drive cells with a scan line address designated by a scan control signal from the outside, and outputs the comparison result to a corresponding one of the scan drive cells.

26 Claims, 11 Drawing Sheets

STV: SCAN START SIGNAL
CPV: SCAN CLOCK SIGNAL

DISPLAY DRIVER, ELECTRO-OPTICAL DEVICE AND DRIVE METHOD

Japanese Patent Application No. 2003-279172, filed on Jul. 24, 2003, is hereby incorporated by reference in its entirety.

BACKGROUND OF THE INVENTION

The present invention relates to a scan driver, an electro-optical device and drive method.

A liquid crystal panel is used as a display section of an electronic instrument such as a portable telephone. In recent years, a still image and a video image containing valuable information have been distributed accompanying widespread use of portable telephones. Therefore, an increase in the image quality of the liquid crystal panel has been demanded.

An active matrix liquid crystal panel using a thin-film transistor (hereinafter abbreviated as "TFT") is known as a liquid crystal panel which realizes an increase in the image quality of the display section of the electronic instrument. The active matrix liquid crystal panel using the TFT realizes high response time and high contrast in comparison with a simple matrix liquid crystal panel using a dynamically driven super twisted nematic (STN) liquid crystal, and is suitable for displaying a video image or the like. Japanese Patent Application Laid-open No. 2002-351412 is known as a conventional example.

However, since the active matrix liquid crystal panel using the TFT consumes a large amount of electric power, power consumption must be reduced in order to employ the active matrix liquid crystal panel as a display section of a battery-driven portable electronic instrument such as a portable telephone. An interlace drive method which reduces power consumption is known. A comb-tooth drive method which reduces coloring errors in each display pixel is also known. The interlace drive method is a drive method suitable for displaying a still image, since the image quality is decreased when applied to a video image.

Therefore, a driver circuit which can deal with various drive methods such as normal drive, interlace drive, and comb-tooth drive is demanded for a display panel (liquid crystal panel, for example) which displays a still image and a video image.

BRIEF SUMMARY OF THE INVENTION

According to one aspect of the present invention, there is provided a display driver which drives at least a plurality of scan lines of a display panel having a plurality of data lines and a plurality of pixels in addition to the scan lines, the display driver comprising:

a plurality of scan drive cells each of which is connected to and drives one of the scan lines; and a plurality of coincidence detection circuits each of which is connected to one of the scan drive cells, wherein each of the coincidence detection circuits compares a scan line address designated by a scan control signal with an address exclusively assigned to at least one of the scan drive cells, and outputs the comparison result to a corresponding one of the scan drive cells.

According to another aspect of the present invention, there is provided a method of driving at least a plurality of scan lines of a display panel having a plurality of data lines and a plurality of pixels in addition to the scan lines, by a plurality of scan drive cells, the method comprising:

designating a scan line address by using a scan control signal;

comparing an address exclusively assigned to at least one of the scan drive cells with the scan line address, and outputting a comparison result to one of the scan drive cells; and causing each of the scan drive cells to drive one of the scan lines.

DETAILED DESCRIPTION OF THE EMBODIMENTS

Figure 1:
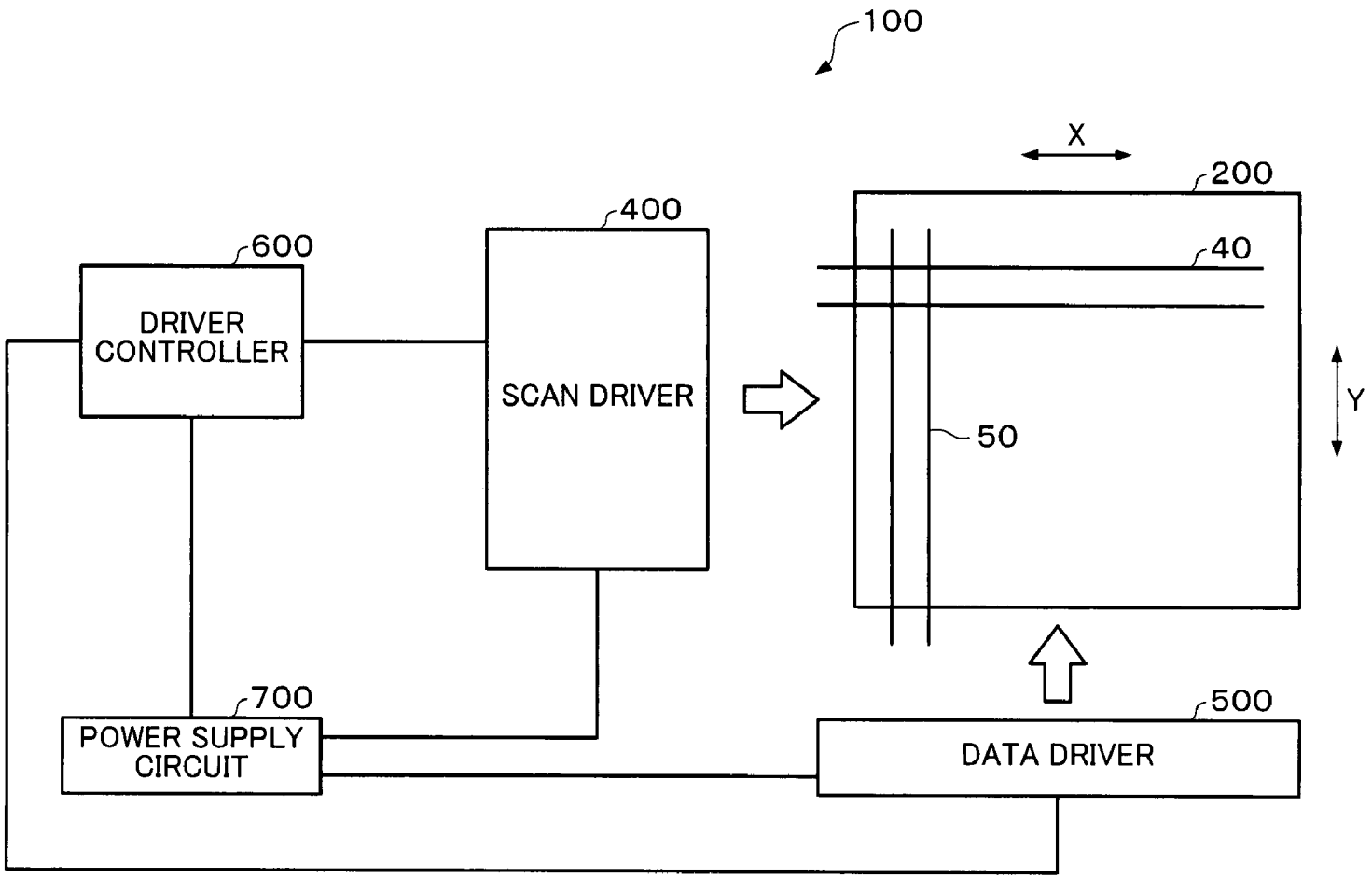
FIG. 1 is a diagram showing an electro-optical device according to one embodiment of the present invention.

Embodiments of the present invention will be described below.

According to one embodiment of the present invention, there is provided a display driver which drives at least a plurality of scan lines of a display panel having a plurality of data lines and a plurality of pixels in addition to the scan lines, the display driver comprising:

a plurality of scan drive cells each of which is connected to and drives one of the scan lines; and a plurality of coincidence detection circuits each of which is connected to one of the scan drive cells, wherein each of the coincidence detection circuits compares a scan line address designated by a scan control signal with an address exclusively assigned to at least one of the scan drive cells, and outputs the comparison result to a corresponding one of the scan drive cells.

This enables the scan lines to be driven in an arbitrary order, whereby it is possible to deal with various drive methods.

The display driver may further comprise a scan line address bus which supplies the scan line address. This enables each of the coincidence detection circuits to be connected to the scan line address bus, so that a corresponding scan line can be selected and driven from among the scan lines by designating an arbitrary scan line address.

In the display driver, the scan line address bus may include a plurality of address signal lines; and the coincidence detection circuits may be connected to the address signal lines differently from each other. This makes it possible that a scan line to be ON-driven is selected from among the scan lines according to connection combination of the address signal lines with the coincidence detection circuits.

In the display driver, each of the coincidence detection circuits may be connected to at least N address signal lines (N is a natural number) among the address signal lines; and each of the coincidence detection circuits may include a logic circuit having at least N inputs. This enables a logic circuit to perform logical computation of addresses provided through the N address signal lines selected from the address signal lines, so that a scan drive cell corresponding to the scan address can be determined.

In the display driver, when one of the coincidence detection circuits determines that the scan line address coincides with the address exclusively assigned to at least one of the scan drive cells, a corresponding one of the scan drive cells may drive a corresponding one of the scan lines. This enables to select a scan line to be ON-driven from among the scan lines.

In the display driver, when none of the scan lines is driven, the scan line address may be set to an address other than the address exclusively assigned to at least one of the scan drive cells. The display panel can be driven without changing the circuit of the display driver even if the number of scan lines of the display panel is smaller than the number of scan drive cells in the display driver.

In the display driver, the scan lines may be sequentially driven by sequentially generating the scan line address. This makes it possible to deal with normal drive of the scan lines without changing the circuit configuration.

In the display driver, the scan lines may be interlace-driven by causing a controller which controls the display driver to generate the scan line address. This makes it possible to deal with interlace drive of the scan lines without changing the circuit configuration.

In the display driver, the scan lines may be comb-tooth driven by causing a controller which controls the display driver to generate the scan line address included in the scan control signal. This makes it possible to deal with comb-tooth drive of the scan lines without changing the circuit configuration.

In the display driver, each of the coincidence detection circuits may include at least one of an output enable input and an output fixed input; each of the coincidence detection circuits may ON-drive a corresponding one of the scan drive cells in a period in which a signal input to the output fixed input is active; and each of the coincidence detection circuits may OFF-drive a corresponding one of the scan drive cells in a period in which a signal input to the output enable input is non-active. This enables the scan drive cells to be ON-driven or OFF-driven independent of the scan control signal.

According to one embodiment of the present invention, there is provided an electro-optical device comprising: the above display driver; the display panel driven by the display driver; and a controller which controls the display driver.

According to one embodiment of the present invention, there is provided a method of driving at least a plurality of scan lines of a display panel having a plurality of data lines and a plurality of pixels in addition to the scan lines, by using a plurality of scan drive cells, the method comprising:

designating a scan line address by using a scan control signal;

comparing an address exclusively assigned to at least one of the scan drive cells with the scan line address, and outputting a comparison result to one of the scan drive cells; and causing each of the scan drive cells to drive one of the scan lines.

This enables the scan lines to be driven in an arbitrary order.

In the driving method, when none of the scan lines is driven, the scan line address may be set to an address other than the address exclusively assigned to at least one of the scan drive cells. This prevents the scan lines from being driven.

These embodiments are further described with reference to the drawings. Note that the embodiments described below do not in any way limit the scope of the invention laid out in the claims herein. In addition, all of the elements of the embodiments described below should not be taken as essential requirements of the present invention.

1. Electro-Optical Device

FIG. 1 shows the configuration of an electro-optical device including a display driver according to one embodiment of the present invention. The electro-optical device is a liquid crystal device in this embodiment. The liquid crystal device 100 may be incorporated in various electronic instruments such as a portable telephone, portable information instrument (such as PDA), wearable information instrument (such as wrist watch type terminal), digital camera, projector, portable audio player, mass storage device, video camera, on-board display, on-board information terminal (car navigation system or on-board personal computer), electronic notebook, or global positioning system (GPS).

The liquid crystal device 100 includes a display panel (optical panel) 200, a scan driver (gate driver) 400, a data driver (source driver) 500, a driver controller 600, and a power supply circuit 700.

The liquid crystal device 100 does not necessarily include all of these circuit blocks. The liquid crystal device 10 may have a configuration in which some of the circuit blocks are omitted. The display driver in this embodiment may have a configuration including only the scan driver 400, a configuration including the scan driver 400 and the data driver 500, or a configuration including the scan driver 400, the data driver 500, and the driver controller 600.

The display panel 200 includes a plurality of scan lines (gate lines) 40, a plurality of data lines (source lines) 50 which intersect the scan lines 40, and a plurality of pixels, each of the pixels being specified by one of the scan lines 40 and one of the data lines 50. In the case where one pixel consists of three color components of RGB, one pixel consists of three dots, one dot each for R, Q and B. The dot may be referred to as an element point which makes up each pixel. The data lines 50 corresponding to one pixel may be referred to as the data lines 50 in the number of color components which make up one pixel. The following description is appropriately given on the assumption that one pixel consists of one dot for convenience of description.

Each pixel includes a thin film transistor (hereinafter abbreviated as "TFT") (switching device in a broad sense), and a pixel electrode. The TFT is connected with the data line 50, and the pixel electrode is connected with the TFT.

The display panel 200 is formed by a panel substrate such as a glass substrate. The scan lines 40 formed along the row direction X shown in FIG. 1 and the data lines 50 formed along the column direction Y shown in FIG. 1 are arranged so that the pixels arranged in a matrix can be appropriately specified. The scan line 40 is connected with the scan driver 400. The data line 50 is connected with the data driver 500.

The scan driver 400 receives a control signal (scan control signal) from the driver controller 600, and drives one of the scan lines 40 corresponding to the control signal. This enables this embodiment to deal with various scan drive methods. As the scan drive method, normal drive (sequential drive), comb-tooth drive, interlace drive, and the like can be given.

2. Scan Driver

Figure 2:
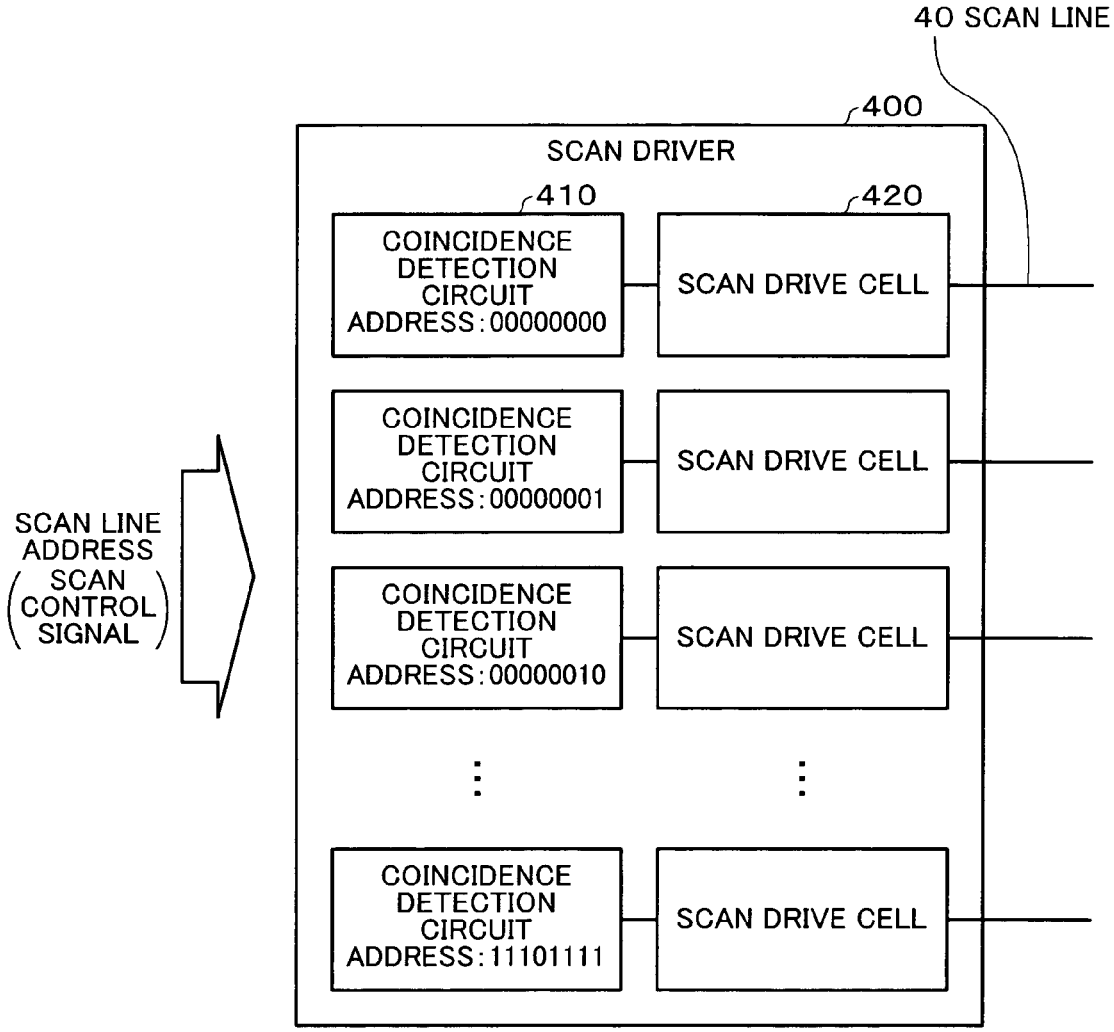
FIG. 2 is a diagram showing configuration of the scan driver of FIG. 1.

FIG. 2 shows the scan driver 400. The scan driver 400 includes a plurality of coincidence detection circuits 410 and a plurality of scan drive cells 420. A scan line address (identification value) exclusive to each coincidence detection circuit 410 is assigned to each coincidence detection circuit 410. The coincidence detection circuit 410 is connected with the scan drive cell 420 which can drive at least one scan line 40, and the scan line 40 of the display panel 200 is connected with the scan drive cell 420.

Figure 3:
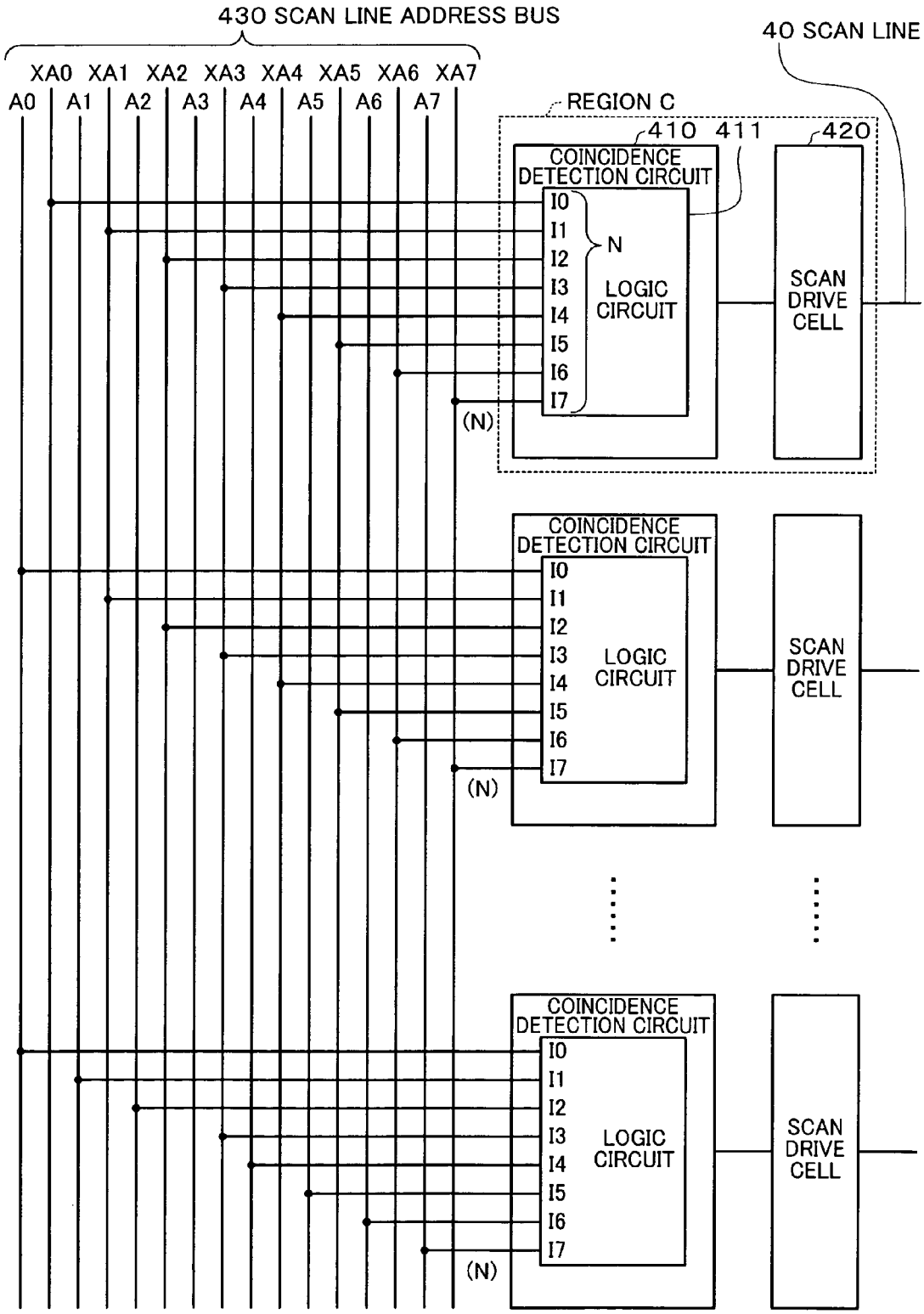
FIG. 3 is a diagram showing the connection between a coincidence detection circuit and a scan line address bus according to one embodiment of the present invention.

The coincidence detection circuit 410 is described below. FIG. 3 is a diagram showing the configuration of the coincidence detection circuit 410 in the scan driver 400. The coincidence detection circuit 410 includes a logic circuit 411. The logic circuit 411 includes inputs I0 to I7 (N inputs in a broad sense, N is a natural number). A scan line address bus 430 includes address signal lines A0 to A7 and XA0 to XA7. The address signal line XA0 indicates a reversed value of the address signal line A0. The address signal lines XA1 to XA7 respectively indicate reversed values of the address signal lines A1 to A7. The connection combination of the inputs I0 to I7 of the logic circuit 411 in the coincidence detection circuit 410 with the address signal lines A0 to A7 and XA0 to XA7 in the scan line address bus 430 is exclusive to each coincidence detection circuit 410. Therefore, the difference in connection pattern between each coincidence detection circuit 410 when connecting the address signal lines A0-A7 and XA0 to XA7 in the scan line address bus 430 with the inputs I0 to I7 of the logic circuit 411 corresponds to the scan line address exclusively assigned to each coincidence detection circuit 410.

A region C shown in FIG. 3 enclosed by a dotted line is used to provide further detailed description. The logic circuit 411 is provided in the coincidence detection circuit 410 in the region C. The inputs I0 to I7 of the logic circuit 411 are connected with eight (N in a broad sense, N is a natural number) address signal lines selected from among the address signal lines A1 to A7 and XA0 to XA7 in the scan line address bus 430. In more detail, the input I0 of the logic circuit 411 is connected with the address signal line XA0 in the scan line address bus 430, the input I1 of the logic circuit 411 is connected with the address signal line XA1 in the scan line address bus 430, the input I2 is connected with the address signal line XA2, and the input I3 is connected with the address signal line XA3. The input I4 of the logic circuit 411 is connected with the address signal line XA4 in the scan line address bus 430, the input I5 is connected with the address signal line XA5, the input I6 is connected with the address signal line XA6, and the input I7 is connected with the address signal line XA7. This connection combination is exclusive, and is not used for connection between other coincidence detection circuits 410 and the scan line address bus 430.

Specifically, in the case where 8-bit data "00000000" is supplied to the coincidence detection circuit 410 from the scan line address bus 430 as the address signal, an active signal (signal which ON-drives the scan line 40) is uniquely supplied to the scan drive cell 420 in the region C from the logic circuit 411 in the coincidence detection circuit 410. The signal line A0 goes active (signal at H level) when the most significant bit of the 8-bit data is "1", and the signal line A7 goes active when the least significant bit of the 8-bit data is "1". Specifically, 8-bit data "00000000" is data which causes the signal lines XA0 to XA7 to go active.

In this embodiment, the scan line 40 is identified by assigning the exclusive scan line address to the coincidence detection circuit 410 connected with the scan drive cell 420. According to this embodiment, in the case of driving an arbitrary scan line 40, it suffices to supply the corresponding scan line address to the scan line address bus 430. In this embodiment, the scan line address bus 430 consists of 16 bits. However, the scan driver 400 may be applied to various display panels by appropriately setting the number of bits of the scan line address bus 430 corresponding to the number of scan lines 40.

The scan drive cell 420 is described below.

Figure 4:
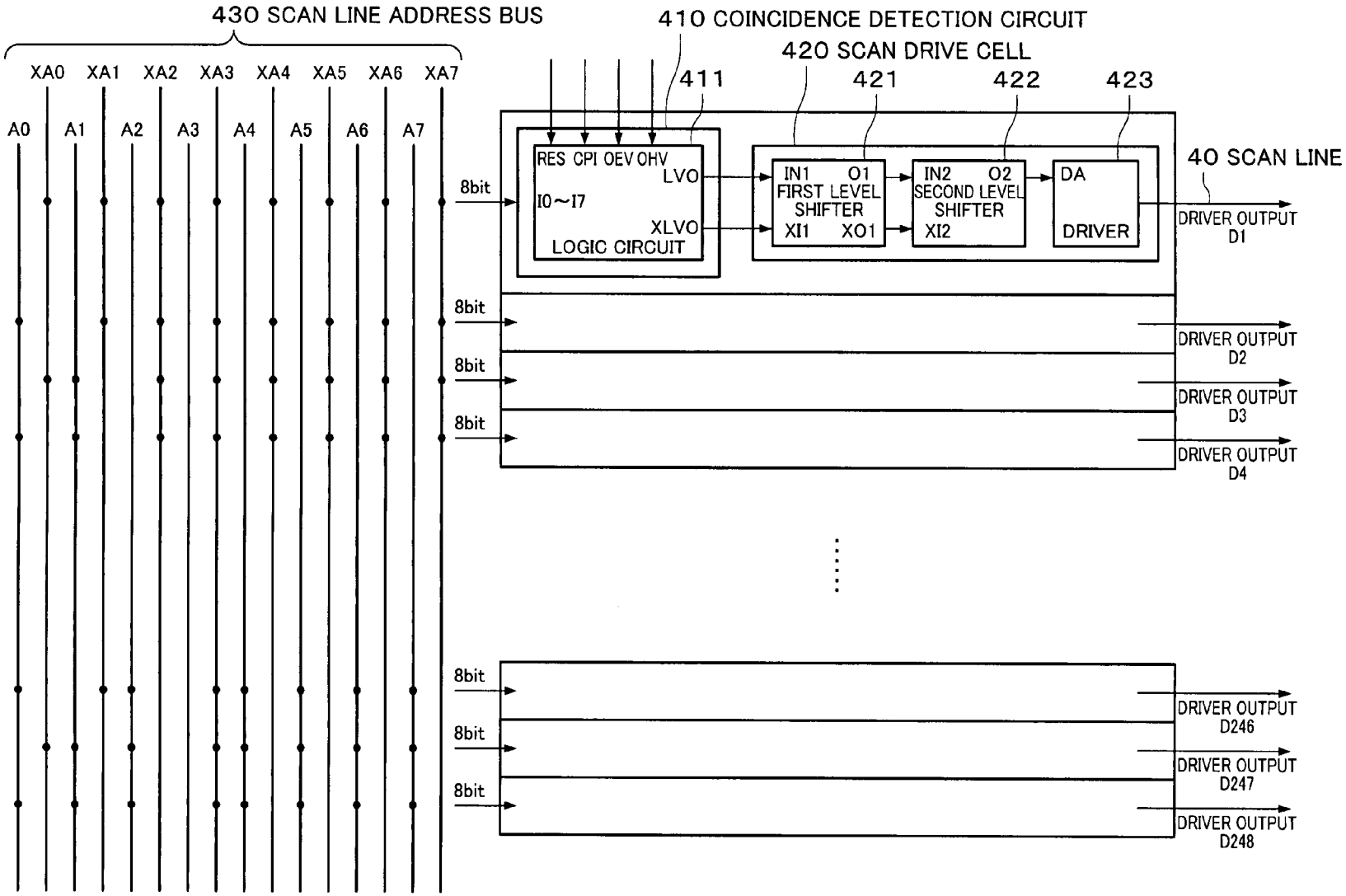
FIG. 4 is a diagram showing configuration of the coincidence detection circuit and the scan drive cell of FIG. 3.

FIG. 4 is a block diagram showing the logic circuit 411 and the scan drive cell 420. The logic circuit 411 (coincidence detection circuit 410) includes the inputs I0 to I7 corresponding to the outputs from the scan line address bus 430, a reset input RES, a scan clock input CPI, an output enable input OEV, and an output fixed input OHV. When a signal at an "L" level is input to the reset input RES, data in a register in the logic circuit 411 is reset, and the coincidence detection circuit 410 OFF-drives the scan drive cell 420 (non-active). In this embodiment, OFF-drive means that the target scan drive cell is unselect-driven, and ON-drive means that the target scan drive cell is select-driven. A scan synchronization pulse is input to the scan clock input CPI. The coincidence detection circuit 410 always OFF-drives the scan drive cell 420 (non-active) in a period in which a signal at an "L" level (non-active) is input to the output enable input OEV of the logic circuit 411. The coincidence detection circuit 410 always ON-drives the scan drive cell 420 (active) in a period in which a signal at an "L" level (active) is input to the output fixed input OHV of the logic circuit 411. Drive of the scan line 40 can be controlled without destroying the data retained in the register (flip-flop) in the logic circuit 411 by using at least one of the output enable input OEV and the output fixed input OHV. The logic circuit 411 includes logic circuit outputs LVO and XLVO which output a drive signal to the scan drive cell 420. The logic circuit output LVO outputs either a signal which ON-drives the scan drive cell 420 (active) or a signal which OFF-drives the scan drive cell 420 (non-active) . The logic circuit output XLVO outputs a signal generated by reversing the signal output from the logic circuit output LVO.

The scan drive cell 420 includes a first level shifter 421, a second level shifter 422, and a driver 423. The first level shifter 421 includes first level shifter inputs IN1 and XI1 and first level shifter outputs O1 and XO1. The logic circuit output LVO is connected with the first level shifter input IN1, and the logic circuit output XLVO is connected with the first level shifter input XI1.

The second level shifter 422 includes second level shifter inputs IN2 and XIN2 and second level shifter outputs O2 and XO2. The first level shifter output O1 is connected with the second level shifter input IN2, and the first level shifter output XO1 is connected with the second level shifter input XI2.

The driver 423 includes a driver input DA. The second level shifter output O2 is connected with the driver input DA of the driver 423. The scan line 40 is connected with the driver 423. The driver 423 drives (ON-drives or OFF-drives) the scan line 40 corresponding to the signal from the second level shifter output O2.

Figure 5:
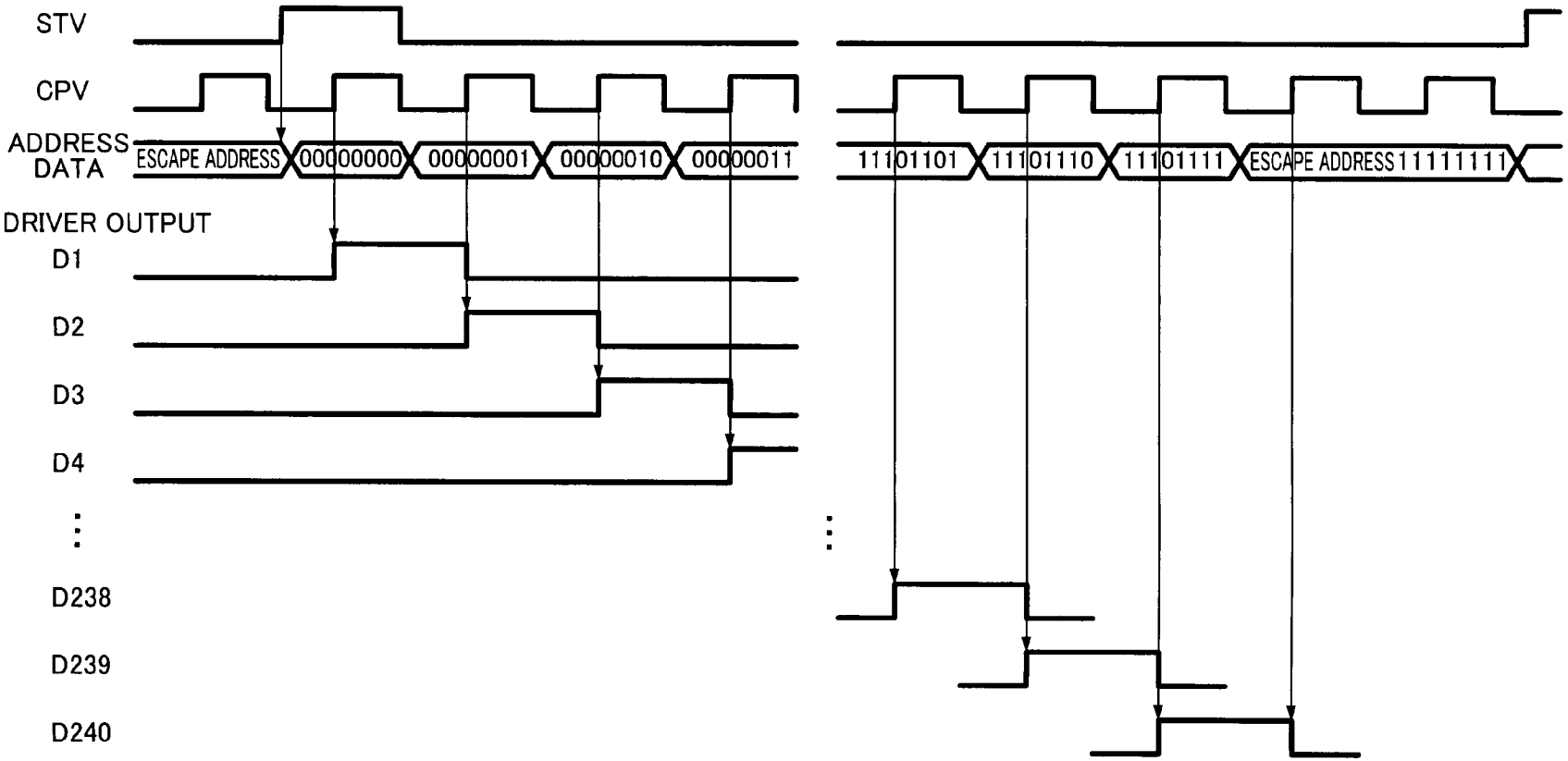
FIG. 5 is a timing chart for the control of the scan driver during the scan line driving according to one embodiment of the present invention.

A method of controlling the scan driver 400 by using the scan control signal is shown in a timing chart of FIG. 5. A symbol STV denotes a scan start signal. The scan start signal STV is a signal supplied to the driver controller 600 from the outside when starting a scan. A symbol CPV denotes a scan clock signal. The scan clock input CPI of the logic circuit 411 receives the scan clock signal CPV. Symbols D1 to D248 denote driver outputs. FIG. 5 shows a timing chart during normal drive (sequential drive) as an example.

The scan drive cell 420 is driven by the corresponding coincidence detection circuit 410 in synchronization with the scan clock signal CPV. The coincidence detection circuit 410 detects coincidence with the scan line address (address data) supplied to the scan line address bus 430. The coincidence detection circuit 410 which coincides with the scan line address (address data) drives the corresponding scan drive cell 420 in synchronization with the scan clock signal CPV.

For example, when an 8-bit address "00000000" is supplied to the scan line address bus 430 as the scan line address (address data), the corresponding scan drive cell 420 selects (ON-drives) the driver output D1 in synchronization with the rising edge of the scan clock signal CPV. The driver outputs D1 to D248 are sequentially selected (ON-driven) in the same manner as described above corresponding to the scan line addresses (address data) in the scan line address bus 430.

An escape address is used as a stop mark after driving all the scan lines 40. An address which is not assigned to the coincidence detection circuits 410 is used as the escape address. It is possible to prevent the scan drive cells 420 from being selected by supplying an 8-bit address "11111111" which is not assigned to the coincidence detection circuits 410 to the scan line address bus 430, for example.

The above-described example illustrates the case of normal drive (sequential drive). However, this embodiment can easily deal with various drive methods such as interlace drive and comb-tooth drive by sequentially generating the scan line address corresponding to the scan line 40 to be driven by using the driver controller 600 (see FIG. 1), for example.

Three types of operations (normal operation mode, normally ON drive, and normally OFF drive) of the logic circuit 411 in the coincidence detection circuit 410 are described below.

Figure 6:
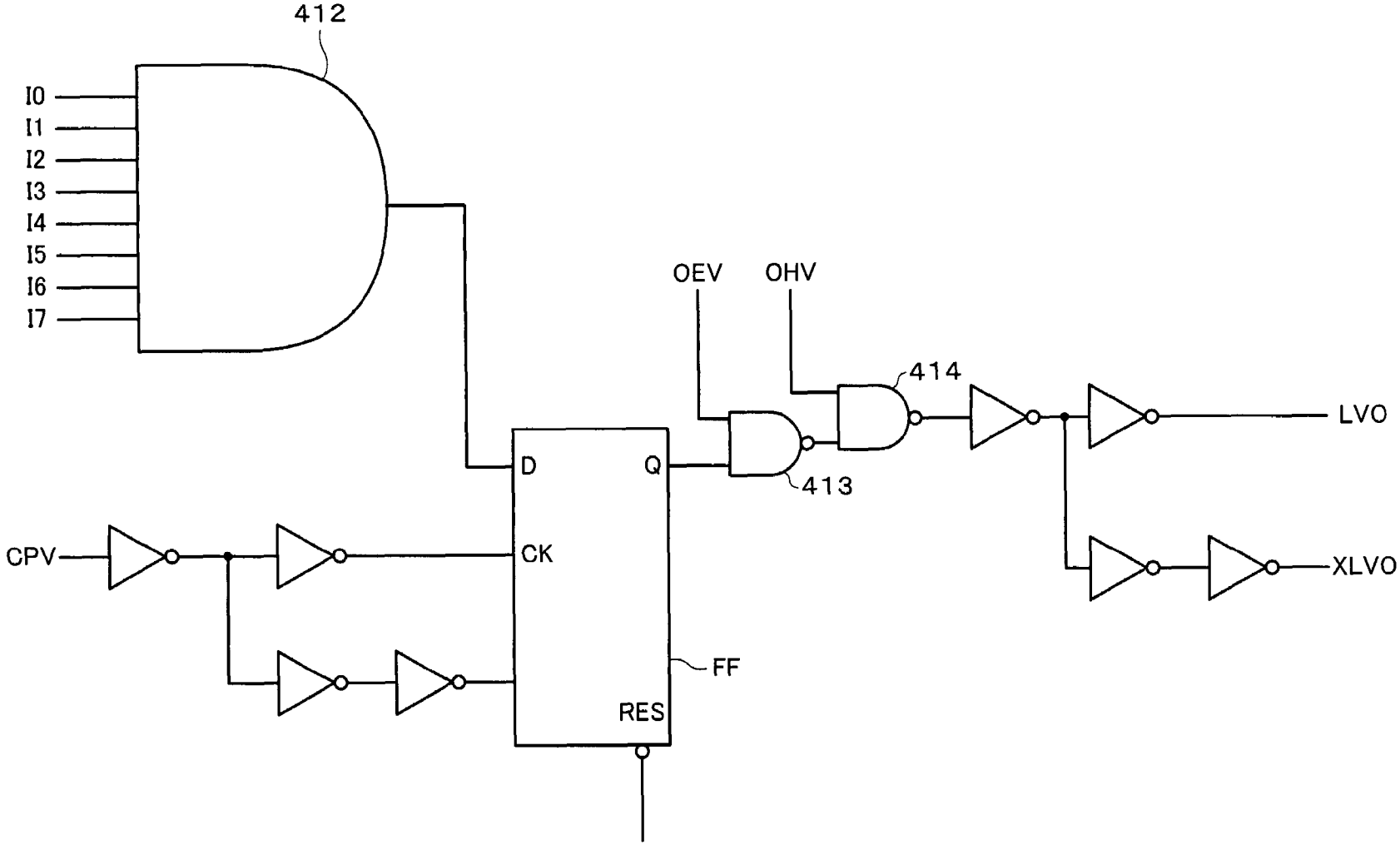
FIG. 6 is a circuit diagram showing the logic circuit of FIG. 4.

FIG. 6 is a circuit diagram of the logic circuit 411. A numeral 412 denotes an eight-input AND circuit. The inputs of the eight-input AND circuit 412 are the inputs I0 to I7 of the logic circuit 411. Numerals 413 and 414 denote NAND circuits. A symbol FF denotes a flip-flop circuit.

In the normal operation mode, a signal at an "H" level is input to the output enable input OEV of the NAND circuit 413, and a signal at an "H" level is input to the output fixed input OHV of the NAND circuit 414. For example, when signals at an "H" level are input to the inputs I0 to I7 and the output of the eight-input AND circuit 412 is at an "H" level, a signal at an "H" level is input to a D terminal of the flip-flop FF. The flip-flop FF latches the data (signal at "H" level) input to the D terminal in synchronization with the rising edge of the scan clock signal CPV input to a CK terminal of the flip-flop FF. A Q terminal is set at an "H" level in a period in which the flip-flop FF latches the data (signal at "H" level). Since a signal at an "H" level is input to the output enable input OEV of the NAND circuit 413 and a signal at an "H" level is input to the output fixed input OHV of the NAND circuit 414, a signal at an "H" level is output from the logic circuit output LVO of the logic circuit 411. A signal at an "L" level generated by reversing the signal output from the logic circuit output LVO is output from the logic circuit output XLVO.

When the output of the eight-input AND circuit 412 is at an "L" level, data for a signal at an "L" level is latched by the flip-flop FF, whereby a signal at an "L" level is output from the logic circuit output LVO.

A signal at an "L" level is input to the output fixed input OHV during normally ON drive (when signal at "H" level is always output from the output LVO). Since the output of the NAND circuit 414 is at an "H" level independent of the output of the NAND circuit 413, the logic circuit output LVO is at an "H" level.

A signal at an "H" level is input to the output fixed input OHV and a signal at an "L" level is input to the output enable input OEV during normally OFF drive (when signal at "L" level is always output from output LVO). Since the output of the NAND circuit 413 is at an "H" level independent of the output of the Q terminal of the flip-flop FF, the output of the NAND circuit 414 is at an "L" level and the logic circuit output LVO is at an "L" level.

Specifically, the operation (normal operation mode, normally ON drive, and normally OFF drive) can be switched by controlling the signals supplied to the output enable input OEV and the output fixed input OHV. When a signal at an "L" level is input to the output fixed input OHV, the operation becomes normally OFF drive (signal at "L" level is always output from the output LVO) independent of the signal input to the output enable input OEV.

The first level shifter 421 in the scan drive cell 420 is described below.

Figure 7:
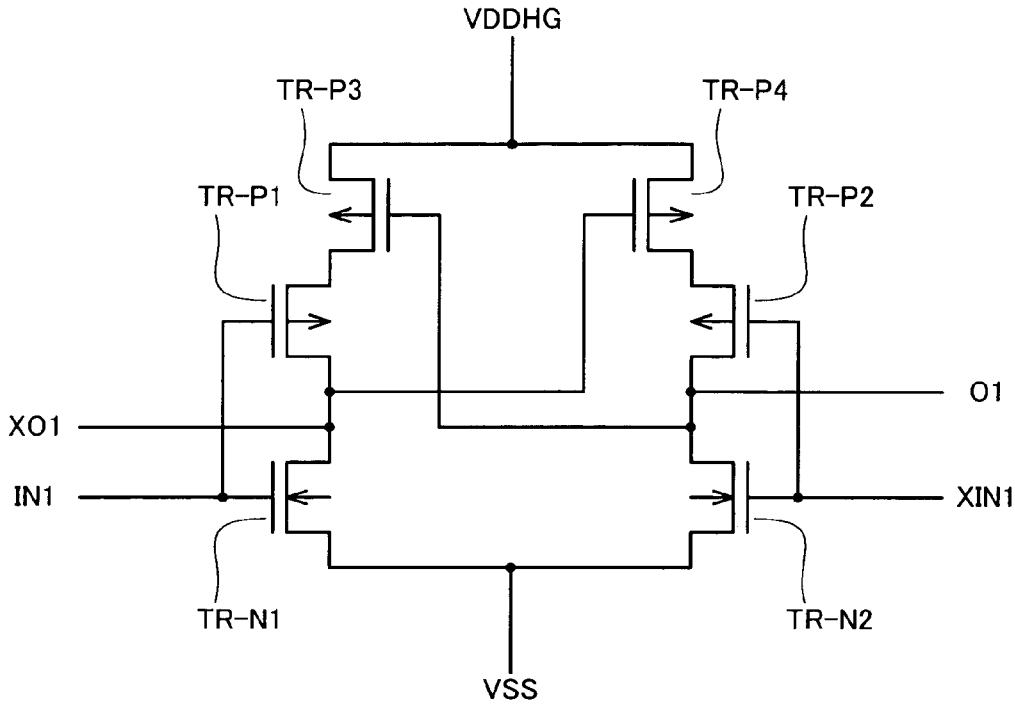
FIG. 7 is a circuit diagram showing a first level shifter in the scan drive cell of FIG. 4.

FIG. 7 is a circuit diagram of the first level shifter 421. The first level shifter 421 includes N-type transistors TR-N1 and TR-N2 (switching devices in a broad sense) and P-type transistors TR-P1 to TR-P4 (switching devices in a broad sense). An "H" level or "L" level is exclusively input to the first level shifter inputs IN1 and XIN1. For example, when a signal at an "H" level is input to the first level shifter input IN1, a signal at an "L" level is input to the first level shifter input XIN1. The first level shifter outputs O1 and XO1 exclusively output an "H" level or "L" level to the second level shifter 422. For example, when a signal at an "H" level is output from the first level shifter output O1, a signal at an "L" level is output from the first level shifter output XO1.

In the case where the scan line address (address data) supplied to the scan line address bus 430 coincides with the address assigned to the coincidence detection circuit 410, the output of the logic circuit output LVO in the coincidence detection circuit 410 is set at an "H" level. A signal at an "H" level is input to the first level shifter input IN1 of the first level shifter 421, and the output (signal at "L" level in this case) of the logic circuit output XLVO is input to the first level shifter input XIN1.

In this case, the N-type transistor TR-N1 is turned ON, and the P-type transistor TR-P1 is turned OFF. This causes a voltage VSS to be output from the first level shifter output XO1. The N-type transistor TR-N2 is turned OFF, and the P-type transistor TR-P2 is turned ON. Since the voltage VSS is input to a gate input of the P-type transistor TR-P4, the P-type transistor TR-P4 is turned ON. As a result, a voltage VDDHG is output to the first level shifter output O1.

When a signal at an "L" level is input to the first level shifter input INI and a signal at an "H" level is input to the first level shifter input XIN1, the P-type transistor TR-P1, the N-type transistor TR-N2, and the P-type transistor TR-P3 are turned ON. The N-type transistor TR-N1, the P-type transistor TR-P2, and the P-type transistor TR-P4 are turned OFF. Therefore, the voltage VDDHG is output from the first level shifter output XO1, and the voltage VSS is output from the first level shifter output O1.

The signals at an "H" level or "L" level output to the first level shifter 421 are level-shifted to the signal level of the voltage VDDHG or the voltage VSS.

The second level shifter 422 is described below.

Figure 8:
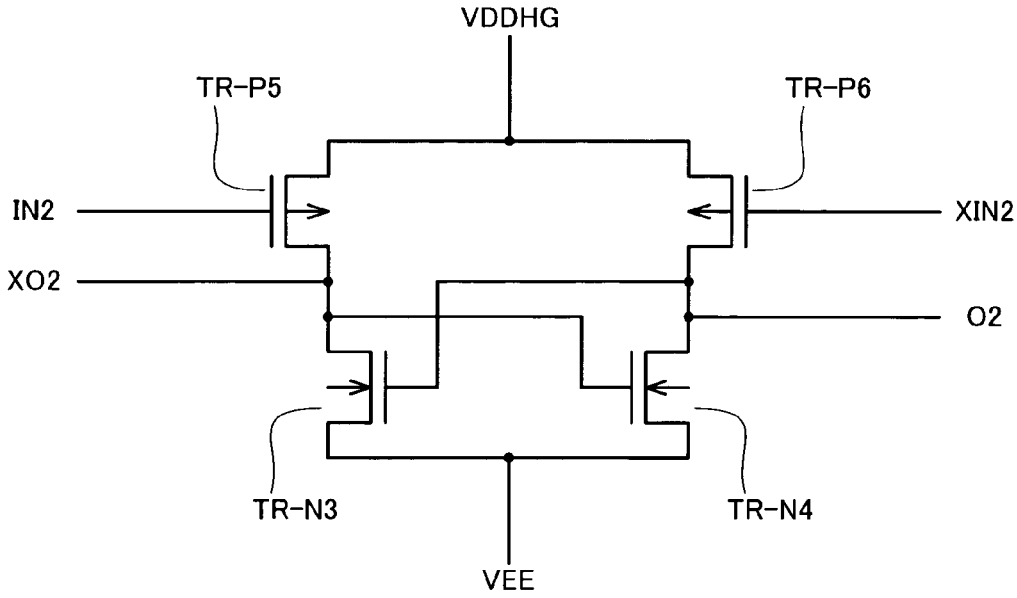
FIG. 8 is a circuit diagram showing a second level shifter in the scan drive cell of FIG. 4.

FIG. 8 is a circuit diagram of the second level shifter 422. The second level shifter 422 includes N-type transistors TR-N3 and TR-N4 and P-type transistors TR-P5 and TR-P6. An "H" level or "L" level is exclusively input to the second level shifter inputs IN2 and XIN2. For example, when a signal at an "H" level is input to the second level shifter input IN2, a signal at an "L" level is input to the second level shifter input XIN2. The second level shifter outputs O2 and XO2 exclusively output an "H" level or "L" level. For example, when a signal at an "H" level is output from the second level shifter output O2, a signal at an "L" level is output from the second level shifter output XO2.

When a signal at the voltage VDDHG is input to the second level shifter input IN2 of the second level shifter 422, a signal at the voltage VSS is exclusively input to the second level shifter input XIN2. In this case, the P-type transistor TR-P5 is turned OFF, and the P-type transistor TR-P6 is turned ON. This causes a signal at the voltage VDDHG to be output from the second level shifter output O2.

A signal at the voltage VDDHG is input to a gate of the N-type transistor TR-N3, whereby the N-type transistor TR-N3 is turned ON. This causes a voltage VEE to be output from the second level shifter output XO2.

When a signal at the voltage VDDHG is input to the second level shifter input XIN2 and a signal at the voltage VSS is input to the second level shifter input IN2, the P-type transistor TR-P5 is turned ON, and the P-type transistor TR-P6 is turned OFF. This causes a signal at the voltage VDDHG to be output from the second level shifter output XO2. A signal at the voltage VDDHG is input to a gate of the N-type transistor TR-N4, whereby the N-type transistor TR-N4 is turned ON. This causes a signal at the voltage VEE to be output from the second level shifter output O2.

Specifically, the signal at the voltage VSS input to the second level shifter input IN2 or XIN2 is level-shifted to the signal at the voltage VEE, and is output from the second level shifter output O2 or XO2.

The driver 423 is described below.

Figure 9:
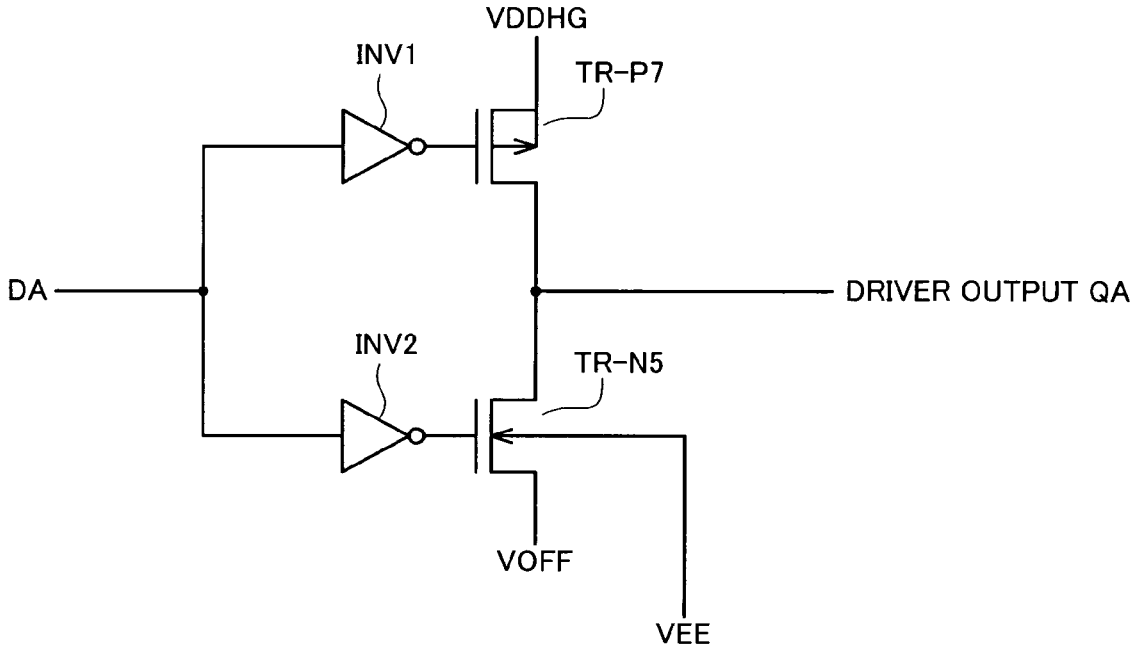
FIG. 9 is a circuit diagram showing a driver in the scan drive cell of FIG. 4.

FIG. 9 is a block diagram of the driver 423. The driver 423 includes an N-type transistor TR-N5 and a P-type transistor TR-P7. The signal output from the second level shifter output O2 is input to a driver input DA. The voltage VDDHG is supplied to a source (or drain) of the P-type transistor TR-P7, and the substrate potential is set at the voltage VDDHG. A voltage VOFF is supplied to a source of the N-type transistor TR-N5, and the substrate potential is set at the voltage VEE.

When a signal at the voltage VDDHG is input to the driver input DA from the second level shifter output O2, the signal is reversed by an inverter INV1, whereby the P-type transistor TR-P7 is turned ON. This causes a signal at the voltage VDDHG to be output from the driver output QA while passing between the source and drain of the P-type transistor TR-P7. The N-type transistor TR-N5 remains in an OFF state. In this case, the signal at the voltage VDDHG input to the driver input DA is reversed by an inverter INV2, and input to the gate of the N-type transistor TR-N5. However, since the substrate potential of the N-type transistor TR-N5 is set at VEE, the gate threshold of the N-type transistor TR-N5 is high, whereby the N-type transistor TR-N5 can be securely turned OFF.

When a signal at the voltage VEE is input to the driver input DA from the second level shifter output O2, the signal is reversed by an inverter INV2, whereby the N-type transistor TR-N5 is turned ON. This causes a signal at the voltage VOFF to be output from the driver output QA while passing between the source and drain of the N-type transistor TR-N5. The P-type transistor TR-P7 remains in an OFF state.

The operation of the scan driver 400 when driving the scan line 40 corresponding to the scan line address (address data) supplied to the scan line address bus 430 is as described above.

3. Effect

It is possible to easily deal with various display panels and scan line drive methods by using this embodiment.

Figure 10:
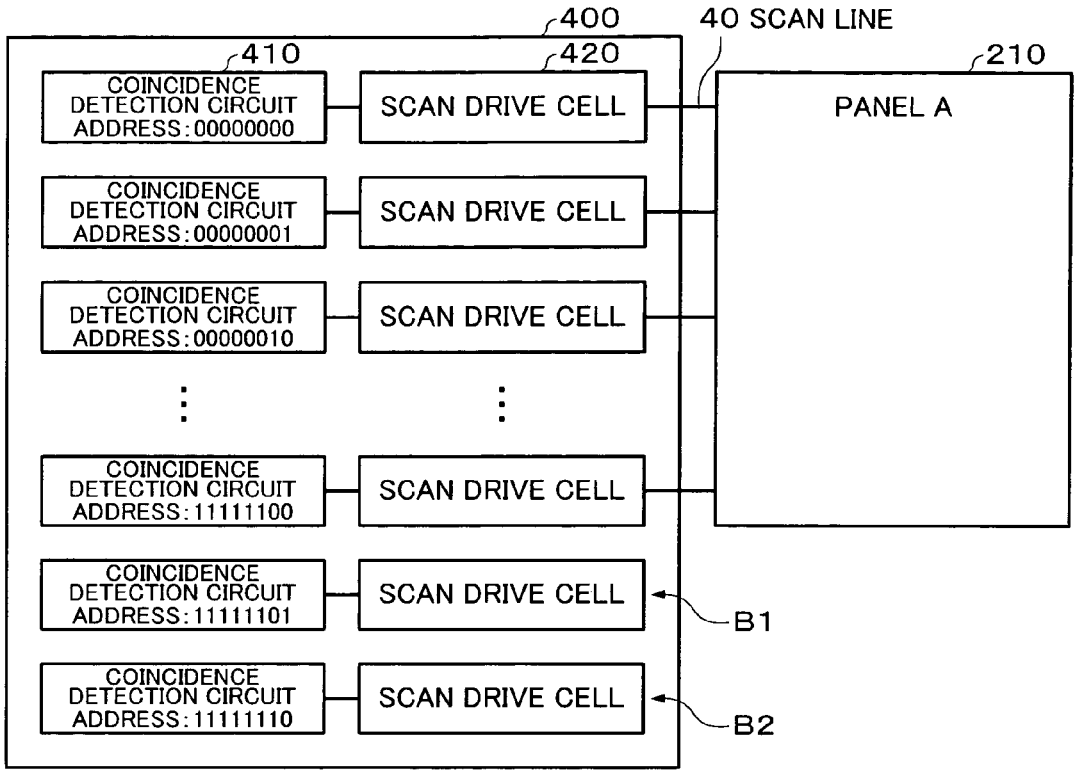
FIG. 10 is a diagram showing the connection of a coincidence detection circuit, a scan drive cell and a panel A according to one embodiment of the present invention.

FIG. 10 is a diagram showing the scan driver 400 when it drives a display panel 210 (hereinafter called "panel A"). The scan driver 400 shown in FIG. 10 includes 255 coincidence detection circuits 410 and 255 scan drive cells 420. The range of 8-bit addresses "00000000" to "11111110" is assigned to the coincidence detection circuits 410 as the scan line addresses. In FIG. 10, the scan drive cell 420 connected with the coincidence detection circuit 410 to which the scan line address "11111101" is assigned (B1 in FIG. 10) and the scan drive cell 420 connected with the coincidence detection circuit 410 to which the scan line address "11111110" is assigned (B2 in FIG. 10) are not connected with the panel A.

Specifically, the number of scan lines 40 provided in the panel A is smaller than the number of scan drive cells 420 provided in the scan driver 400. However, since this embodiment uses the escape address (address other than the addresses assigned to the scan drive cells, or address which is not assigned to the scan drive cells) during drive, the panel A can be driven without changing the circuit configuration of the scan driver 400. The panel A can be driven by supplying "11111100", which is the final address connected with the panel A, to the scan line address bus 430, and then supplying the escape address ("11111111", for example) to the scan line address bus 430.

Figure 11:
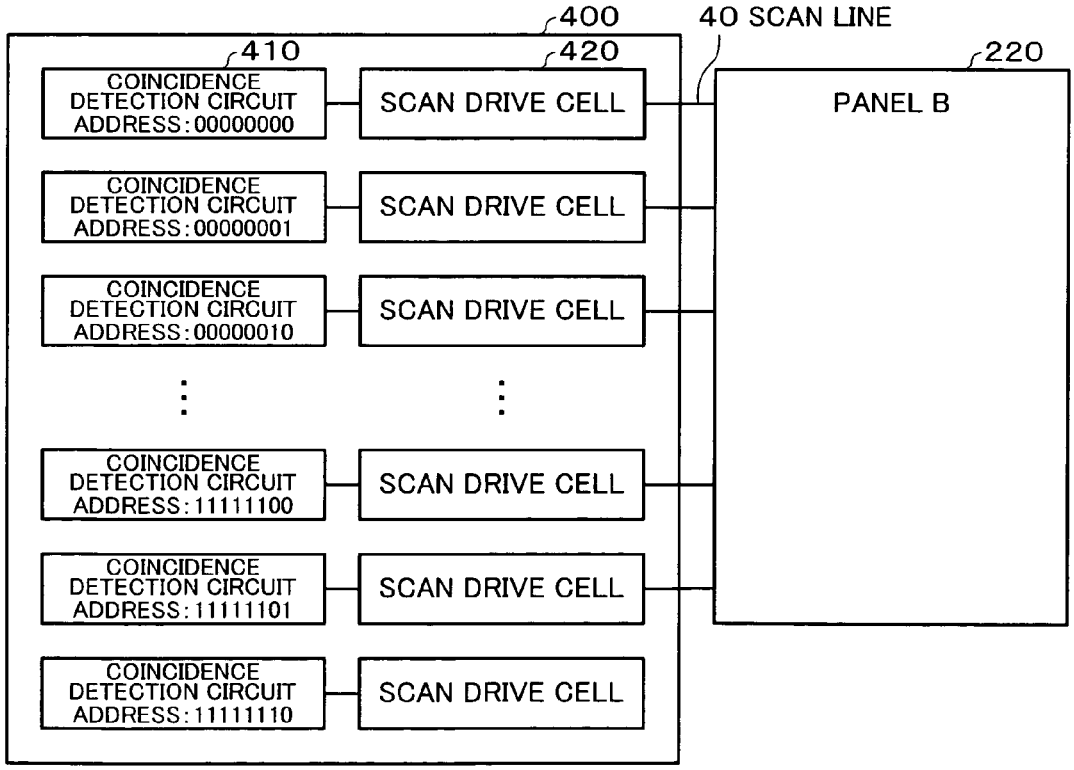
FIG. 11 is a diagram showing the connection of a coincidence detection circuit, a scan drive cell and a panel B according to one embodiment of the present invention.

FIG. 11 is a diagram showing the scan driver 400 when it drives a display panel 220 (hereinafter called "panel B"). In this case, the panel B can be driven by supplying "11111101" which is the final address connected with the panel B to the scan line address bus 430, and then supplying the escape address ("11111111", for example) to the scan line address bus 430 during scan drive.

The scan driver 400 can be utilized for various display panels by controlling the timing at which the escape address is supplied to the scan line address bus 430 as described above.

Figure 12:
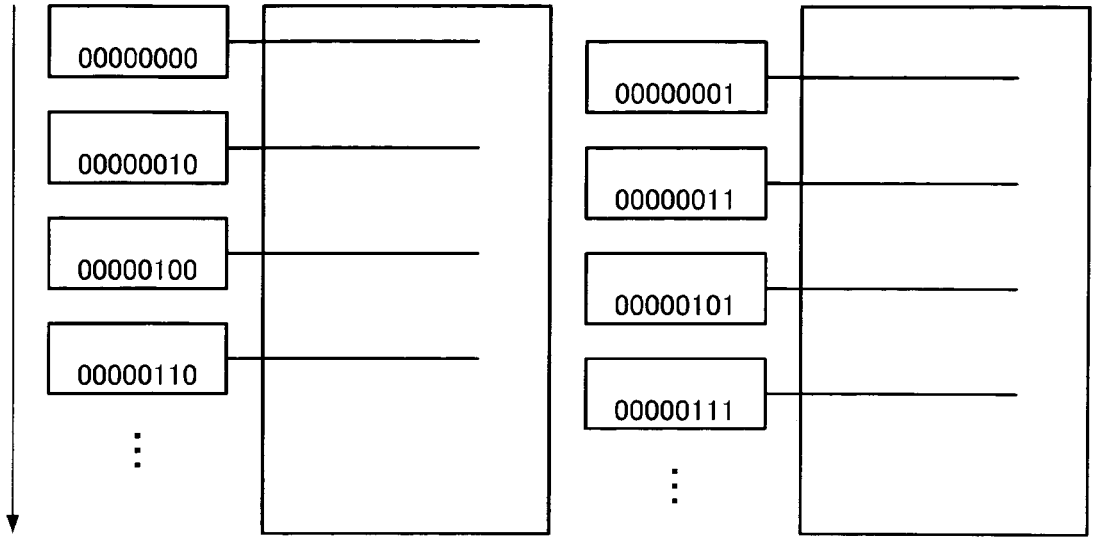
FIG. 12 is a diagram showing interlace drive.

FIG. 12 is a diagram showing interlace drive (one line omission). In interlace drive (one line omission), the first scan line 40 is ON-driven, and the third scan line 40 is then ON-driven without driving the second scan line 40. The fifth scan line 40 is ON-driven without driving the fourth scan line 40. When the turn reaches the last scan line 40, the scan lines 40 which have been omitted are sequentially ON-driven.

As described above, the scan lines 40 are sequentially ON-driven while omitting one scan line 40, and the scan lines 40 which have been omitted are sequentially ON-driven when the scan line 40 which can be omitted does not exist.

In this embodiment, the drive order may be designated by the scan line address when performing interlace drive. For example, the addresses "00000000", "00000010", "00000100", "00000110" . . . are supplied to the scan line address bus 430 as the scan line addresses, as shown in FIG. 12. The addresses "00000001", "00000011", "00000101", "00000111" . . . are then supplied to the scan line address bus 430. This enables this embodiment to deal with interlace drive without changing the circuit configuration of the scan driver 400.

FIG. 12 shows an example of one line omission, but in the case of three line omission, the scan lines may be sequentially driven during scan drive while omitting designation of three addresses of the coincidence detection circuits 410. Specifically, it is possible to deal with various types of interlace drive merely by setting the number of omissions.

Figure 13:
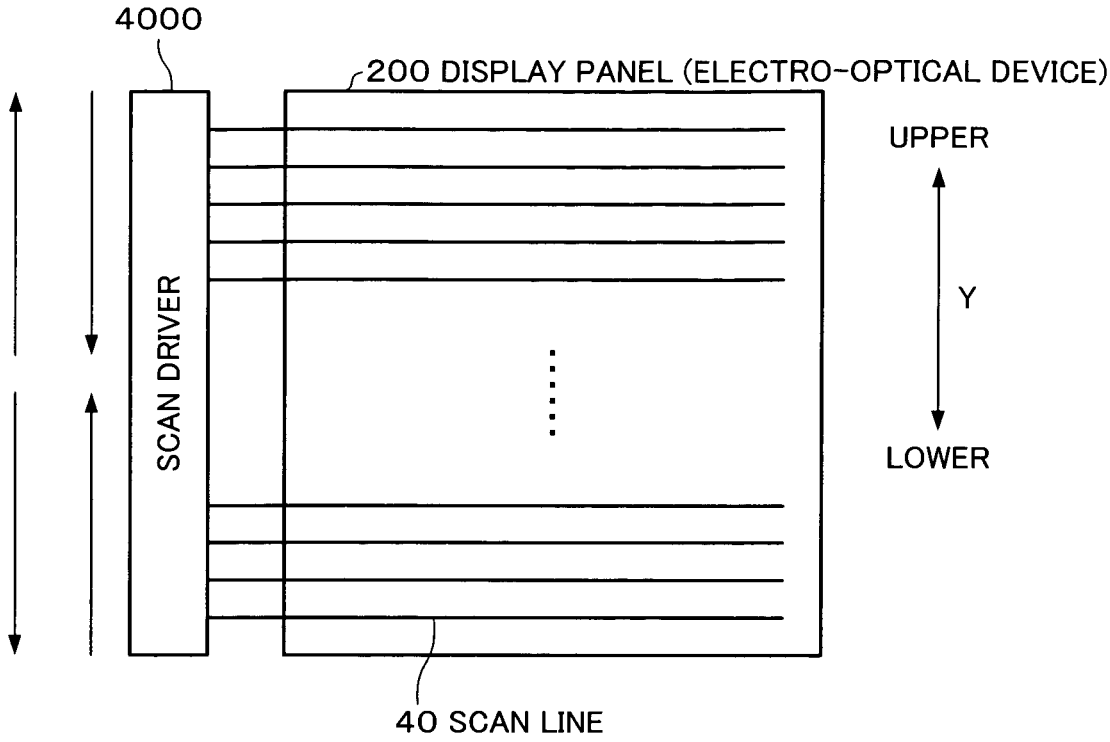
FIG. 13 is a diagram showing comb-tooth drive.

This embodiment can also deal with comb-tooth drive. FIG. 13 is illustrative of comb-tooth drive. In normal drive, the scan lines 40 are sequentially driven from the top to the bottom along the column direction Y shown in FIG. 13. In comb-tooth drive, the scan lines 40 are simultaneously ON-driven toward the center from both ends. Specifically, the uppermost scan line 40 in the column direction Y is ON-driven, and the lowermost scan line 40 in the column direction Y is ON-driven. The scan lines 40 are then sequentially ON-driven toward the center from both ends. The comb-tooth drive method also includes the case where the scan lines 40 are ON-driven from the center toward both ends along the column direction Y In this embodiment, since the scan line address is assigned to each scan line 40, the address may be supplied to the scan line address bus 430 in the drive order. In the case of comb-tooth drive in which the scan lines 40 are ON-driven toward the center from both ends along the column direction Y, the uppermost scan line address in the column direction Y and the lowermost scan line address in the column direction Y are supplied to the scan line address bus 430. The scan line addresses are then supplied to the scan line address bus 430 toward the center from both ends. This makes it possible to deal with comb-tooth drive.

In a conventional method, it is necessary to separately provide a logic circuit for interlace drive or comb-tooth drive to the scan driver 400. Moreover, it is necessary to form a complicated logic circuit in order to deal with all of normal drive, interlace drive, and comb-tooth drive.

In this embodiment, since various drive methods can be dealt with without using such a complicated circuit, the manufacturing cost can be reduced and versatility can be increased.

The present invention is not limited to this embodiment. Various modifications and variations are possible within the spirit and scope of the present invention. For example, the configuration of the coincidence detection circuit is not limited to the configuration shown in FIG. 6. A circuit configuration logically equivalent to the configuration shown in FIG. 6 may be employed. The configuration of the scan drive cell is not limited to the configuration described with reference to FIGS. 4 and 7 to 9. For example, the number of level shifters may be one.

This embodiment illustrates an example in which the present invention is applied to an active matrix liquid crystal device. However, the present invention may be applied to a simple matrix liquid crystal device or the like. The present invention may also be applied to an electro-optical device (organic EL device, for example) other than the liquid crystal device.

The terms (liquid crystal device, TFT, inputs I0 to I7, eight, and the like) cited in the description in the specification and the drawings as the terms in a broad or similar sense (electro-optical device, switching device, N inputs and the like) may be replaced by the terms in a broad or similar sense in another description in the specification and the drawings.

What is claimed is:

1. A display driver which drives at least a plurality of scan lines of a display panel having a plurality of data lines and a plurality of pixels in addition to the plurality of scan lines, the display driver comprising:

a plurality of scan drive cells each of which is connected to and drives one of the plurality of scan lines; and a plurality of coincidence detection circuits each of which is connected to one of the plurality of scan drive cells, each of the plurality of coincidence detection circuits including a logic circuit for comparing a scan line address designated by a scan control signal with an address exclusively assigned to at least one of the plurality of scan drive cells, each of the plurality of coincidence detection circuits including a register which latches a comparison result of the logic circuit based on a scan clock signal, the comparison result representing whether the scan line address designated by the scan control signal coincides with the address exclusively assigned to at least the one of the plurality of scan drive cells, and each of the plurality of coincidence detection circuits outputting a signal based on the comparison result to a corresponding one of the plurality of scan drive cells in synchronization with the scan clock signal.

2. The display driver as defined in claim 1, further comprising a scan line address bus which supplies the scan line address.

3. The display driver as defined in claim 2, the scan line address bus including a plurality of address signal lines, and the plurality of coincidence detection circuits being connected to the plurality of address signal lines differently from each other.

4. The display driver as defined in claim 3, each of the plurality of coincidence detection circuits being connected to at least N address signal lines, N being a natural number, among the plurality of address signal lines, and each of the plurality of coincidence detection circuits including a logic circuit having at least N inputs.

5. An electro-optical device comprising:

the display driver as defined in claim 3;

the display panel driven by the display driver; and a controller which controls the display driver.

6. The display driver as defined in claim 1, when one of the plurality of coincidence detection circuits determines that the scan line address coincides with the address exclusively assigned to at least one of the plurality of scan drive cells, a corresponding one of the plurality of scan drive cells driving a corresponding one of the plurality of scan lines.

7. An electro-optical device comprising:

the display driver as defined in claim 6;

the display panel driven by the display driver; and a controller which controls the display driver.

8. The display driver as defined in claim 1, when none of the plurality of scan lines is driven, the scan line address being set to an address other than the address exclusively assigned to at least one of the plurality of scan drive cells.

9. An electro-optical device comprising:

the display driver as defined in claim 8;

the display panel driven by the display driver; and a controller which controls the display driver.

10. The display driver as defined in claim 1, the plurality of scan lines being sequentially driven by sequentially generating the scan line address.

11. The display driver as defined in claim 1, the plurality of scan lines being interlace-driven by causing a controller which controls the display driver to generate the scan line address.

12. The display driver as defined in claim 1, the plurality of scan lines being comb-tooth driven by causing a controller which controls the display driver to generate the scan line address.

13. The display driver as defined in claim 1, each of the plurality of coincidence detection circuits including at least one of an output enable input and an output fixed input, each of the plurality of coincidence detection circuits ON-driving a corresponding one of the plurality of scan drive cells in a period in which a signal input to the output fixed input being active, and each of the plurality of coincidence detection circuits OFF-driving a corresponding one of the plurality of scan drive cells in a period in which a signal input to the output enable input being non-active.

14. An electro-optical device comprising:

the display driver as defined in claim 1;

the display panel driven by the display driver; and a controller which controls the display driver.

15. The display driver as defined in claim 1, each of the plurality of coincidence detection circuits including a second logic circuit, the second logic circuit receiving the comparison result from the register and an output control signal from an output control terminal, and controlling the output of each of the plurality of scan drive cells based on the comparison result and the output control signal.

16. The display driver as defined in claim 1, each of the plurality of coincidence detection circuits including a first logic circuit, a second logic circuit, and a register, the first logic circuit comparing a scan line address designated by a scan control signal with an address of one of the plurality of scan drive cells, and outputting a first signal, the resister latching the first signal, and outputting a second signal in synchronization with the scan clock, and the second logic circuit outputting a third signal to one of the plurality of scan drive cells, the third signal being based on the second signal.

17. A method of driving at least a plurality of scan lines of a display panel having a plurality of data lines and a plurality of pixels in addition to the plurality of scan lines, by using a plurality of scan drive cells, the method comprising:

designating a scan line address by using a scan control signal;

comparing an address exclusively assigned to at least one of the plurality of scan drive cells with the scan line address;

latching a comparison result based on a scan clock signal, the comparison result representing whether the scan line address coincides with the address exclusively assigned to at least one of the plurality of the scan drive cells;

outputting a signal based on the comparison result to one of the plurality of scan drive cells in synchronization with the scan clock signal; and causing the one of the plurality of scan drive cells to drive one of the plurality of scan lines.

18. The method as defined in claim 17, when none of the plurality of scan lines is driven, the scan line address being set to an address other than the address exclusively assigned to at least one of the plurality of scan drive cells.

19. The method as defined in claim 17, the plurality of scan lines being sequentially driven by sequentially generating the scan line address.

20. The method as defined in claim 17, the plurality of scan lines being interlace-driven by causing a controller which controls a display driver to generate the scan line address, the display driver driving the display panel.

21. The method as defined in claim 17, the plurality of scan lines being comb-tooth driven by causing a controller which controls a display driver to generate the scan line address, the display driver driving the display panel.

22. The method as defined in claim 17, each of the plurality of scan drive cells being ON-driven in a period in which a signal input to an output fixed input included in each of a plurality of coincidence detection circuits being active, each of the plurality of coincidence detection circuits being connected to one of the plurality of scan drive cells and comparing the scan line address with the address exclusively assigned to at least one of the plurality of scan drive cells, and each of the plurality of scan drive cells being OFF-driven in a period in which a signal input to an output enable input included in each of the plurality of coincidence detection circuits being non-active.

23. The method as defined in claim 17, the method comprising:

receiving the comparison result from a register and an output control signal from an output control terminal; and controlling the output of each of the plurality of scan drive cells based on the comparison result and the output control signal.

24. The method as defined in claim 17, further comprising:

generating a first signal, the first signal representing the comparison result;

outputting a second signal in synchronization with the scan clock signal; and outputting a driving signal from the one of the plurality of the scan drive cells to one of the plurality of scan lines, the driving signal being based on the second signal.

25. A display driver which drives at least a plurality of scan lines of a display panel, the display driver comprising:

a plurality of scan drive cells each of which drives one of the plurality of scan lines; and a plurality of coincidence detection circuits each of which is connected to one of the plurality of scan drive cells, each of the plurality of coincidence detection circuits including a first logic circuit, a second logic circuit, and a register, the first logic circuit comparing a scan line address designated by a scan control signal with an address exclusively assigned to one of the plurality of scan drive cells, and outputting a first signal, the first signal representing whether the scan line address designated by the scan control signal coincides with the address exclusively assigned to the one of the plurality of scan drive cells, the register latching the first signal, and outputting a second signal in synchronization with a scan clock, the second signal being based on the first signal, and the second logic circuit outputting a third signal to one of the plurality of scan drive cells, the third signal being based on the second signal.

26. A method of driving a plurality of scan lines of a display panel, the method comprising:

comparing an address exclusively assigned to one of a plurality of scan drive cells with a scan line address designated by a scan control signal;

generating a first signal representing whether the scan line address coincides with the address exclusively assigned to the one of the plurality of scan drive cells;

latching the first signal and outputting a second signal in synchronization with a scan clock signal, the second signal being based on the first signal;

outputting a third signal to the one of the plurality of the scan drive cells, the third signal being based on the second signal; and outputting a driving signal from the one of the plurality of the scan drive cells to one of the plurality of scan lines.

* * * * *

UNITED STATES PATENT AND TRADEMARK OFFICE

CERTIFICATE OF CORRECTION

PATENT NO. : 7,583,246 B2
APPLICATION NO. : 10/891003
DATED : September 1, 2009
INVENTOR(S) : Satoru Ito It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 920 days.

Signed and Sealed this

Fourteenth Day of September, 2010

David J. Kappos

David J. Kappos
*Director of the United States Patent and Trademark Office*